US009586258B2

(12) United States Patent
Faudan et al.

(10) Patent No.: US 9,586,258 B2
(45) Date of Patent: Mar. 7, 2017

(54) MOLDING DEVICE FOR A METAL INGOT COMPRISING A BORE

(71) Applicant: ARCELORMITTAL INVESTIGACIÓN Y DESARROLLO, S.L., Sestao Bizkaia (ES)

(72) Inventors: Thierry Faudan, Le Creusot (FR); Jean-Luc Dabin, Perreuil (FR); Gilbert Lacagne, Blanzy (FR); Maxime Leroy, Perreuil (FR); Bruno Savalli, Saint Laurent d'Andenay (FR); Franck Braconnier, Le Creusot (FR)

(73) Assignee: ARCELORMITTAL INVESTIGACIÓN Y DESARROLLO S.L., Sestao Bizkaia (ES)

( * ) Notice: Subject to any disclaimer, the term of this patent is extended or adjusted under 35 U.S.C. 154(b) by 0 days.

(21) Appl. No.: 14/500,018

(22) Filed: Sep. 29, 2014

(65) Prior Publication Data

US 2015/0013931 A1 Jan. 15, 2015

Related U.S. Application Data

(62) Division of application No. 13/503,115, filed as application No. PCT/FR2009/052014 on Oct. 21, 2009, now Pat. No. 8,875,776.

(51) Int. Cl.

| | |
|---|---|
| ***B22D 7/04*** | (2006.01) |
| ***B22D 7/06*** | (2006.01) |
| ***B22D 18/06*** | (2006.01) |

(52) U.S. Cl.

CPC ..... *B22D 7/06* (2013.01); *B22D 7/04* (2013.01); *B22D 18/06* (2013.01)

(58) Field of Classification Search

CPC ..... B22D 7/04; B22D 7/06; B22D 18/06

(Continued)

(56) References Cited

U.S. PATENT DOCUMENTS

| | | | | |
|---|---|---|---|---|
| 3,310,850 | A | 3/1967 | Warner | |
| 4,047,556 | A * | 9/1977 | Obinata et al. | 164/473 |

(Continued)

FOREIGN PATENT DOCUMENTS

| | | |
|---|---|---|
| FR | 2422459 A1 | 11/1979 |
| FR | 2676670 A1 | 11/1992 |

(Continued)

OTHER PUBLICATIONS

Ohashi Nobuo et al. "Manufacturing process and properties of nuclear RPV shell ring forced from hollow ingot," Nuclear Engineering and Design. vol. 81, No. 2., Sep. 1984. pp. 193-205, XP002596085.

(Continued)

*Primary Examiner* — Kevin P Kerns

(74) *Attorney, Agent, or Firm* — Davidson, Davidson & Kappel, LLC

(57) ABSTRACT

A molding device for vacuum casting a metal ingot is provided. The mold includes a mold cavity defined by an ingot mold, a core and a bottom. The mold is arranged inside a vacuum-cast enclosure and includes a source of introducing molten metal at the upper portion thereof. A distribution device for receiving and distributing molten metal, which is suitable for receiving the molten steel introduced into the vacuum-cast enclosure and for redistributing the molten metal in the mold cavity, is arranged at the upper portion of the mold cavity. The molten metal is introduced into the enclosure so as to form a first jet of molten steel under a vacuum, in order to pour the molten metal over the distribution device and to form at least one second jet of molten (Continued)

steel under a vacuum, which originates with the distribution device and terminates in the mold cavity so as to fill the mold cavity with molten metal.

16 Claims, 3 Drawing Sheets

(58) Field of Classification Search
USPC ..... 164/464, 465, 421, 253, 254, 256
See application file for complete search history.

(56) References Cited

U.S. PATENT DOCUMENTS

| | | | | |
|---|---|---|---|---|
| 4,278,124 | A | 7/1981 | Aso et al. | |
| 5,052,469 | A | 10/1991 | Yanagimoto et al. | |
| 8,875,776 | B2 * | 11/2014 | Faudan et al. | 164/63 |
| 2008/0105400 | A1 | 5/2008 | Shiraki et al. | |

FOREIGN PATENT DOCUMENTS

| | | | | | |
|---|---|---|---|---|---|
| JP | S54134034 | A | | 10/1979 | |
| JP | S54143703 | A | | 11/1979 | |
| JP | 56-33164 | A | * | 4/1981 | B22D 27/02 |
| JP | H05318027 | A | | 12/1993 | |
| JP | H0655244 | A | | 3/1994 | |
| JP | H06190538 | A | | 7/1994 | |
| JP | 2006159213 | A | | 6/2006 | |
| SU | 276111 | | | 7/1970 | |
| SU | 1088868 | A1 | | 4/1984 | |
| SU | 1359062 | A1 | | 12/1987 | |

OTHER PUBLICATIONS

Mikio Kusuhashi et al. "Manufacturing of low neutron irradiation einbrittlement sensitivity core region shells for nuclear reactor pressure vessels," EJAM—E-Journal of Advanced Maintenance, vol. 1, Feb. 3, 2009. pp. 87-89, XP002596086.

Aso Kazuo et al. "Manufacture of forged shell rings for PWR nuclear reactor vessels," Kawasaki Steel Technical Report, No. 15, Oct. 1986. pp. 65-73, XP002596087.

Office Action is Russian Application No. 2012/120723/02, pp. 1-4 (Dec. 16, 2013).

* cited by examiner

MOLDING DEVICE FOR A METAL INGOT COMPRISING A BORE

CROSS REFERENCE TO RELATED APPLICATIONS

This is a divisional of U.S. application Ser. No. 13/503,115 filed on Jul. 6, 2012 and issued as U.S. Pat. No. 8,875,776 on Nov. 4, 2014 which is a national stage of PCT/FR2009/052014 filed on Oct. 21, 2009, the entire disclosures of which are hereby incorporated by reference herein.

The present invention relates to the manufacture of a metal ingot comprising a longitudinal bore, and in particular a steel ingot intended to produce forged annular pieces.

BACKGROUND

To produce forged annular pieces, such as sleeves, for example to build nuclear power plant vessels or petrochemical reactors, it is known to use ingots that are solid, which must then be subject to a forging operation including the piercing of an axial hole, or direct casting of ingots comprising a central bore that can be transformed directly in the form of a sleeve.

These two types of ingots in particular differ in terms of the casting conditions, which result in particular in hydrogen contents kept in the molten state and that can have an impact both on the properties of the obtained pieces and the manufacturing conditions.

The solid ingots can be vacuum cast, which allows them to be made from steel that has been degassed during the vacuum casting, to obtain hydrogen content levels guaranteed to be less than 1 ppm.

However, the ingots comprising a central bore are bottom cast in the air. These ingots are cast using metal or molten steel that has been degassed during ladle metallurgy operations, and which in general have a guaranteed hydrogen content below 1.5 ppm. However, during bottom casting, through the passage through the air and the contact with the refractories that constitute the source, the steel regains a hydrogen quantity in the vicinity of 0.3 ppm, and it is therefore difficult to obtain ingots for which it is possible to guarantee, when the steel is in the molten state in the ingot mold, a hydrogen content below 1.8 ppm.

However, for certain applications, and in particular for applications in the field of the construction of nuclear reactors, it is necessary to obtain parts whereof the hydrogen content on the finished pieces is less than 0.8 ppm. Such content levels can be obtained with vacuum cast solid ingots in particular when the pressure in the vacuum cast enclosure is in the vicinity of 0.1 Torr. However, with bottom cast ingots, and in particular ingots comprising a longitudinal bore, this guarantee can only be obtained by subjecting the pieces during forging to a series of long and costly thermal treatments intended in particular to diffuse the oxygen. It therefore results from these differences that although ingots having a longitudinal bore can be forged with a simplified forging process relative to solid ingots, they on the other hand require very long and very expensive degassing treatments that make the process more complicated.

However, although the solid ingots have a low hydrogen content level and therefore do not require degassing treatments, they require a more complicated forging process. In fact, this process must include at least one step intended to produce a central hole that requires several forging and heating operations in furnaces.

BRIEF SUMMARY OF THE INVENTION

An object of the present invention is to resolve these drawbacks by proposing a means for obtaining forged ingots having a longitudinal bore, while having a low enough hydrogen content from the beginning, so as to guarantee low hydrogen content conditions on the finished pieces, without many degassing heat treatments being necessary.

The present invention provides a method for producing a metal ingot comprising a longitudinal bore, through molten metal casting in a mold comprising a generally annular mold cavity, delimited by an ingot mold extending vertically above a support, the ingot mold comprising an upwardly open cavity, by a vertical core positioned inside the cavity of the ingot mold, and by a bottom.

According to this method:

- the mold is positioned inside a vacuum-cast enclosure including a means for introducing molten metal at the upper portion thereof;
- a means for receiving and distributing molten metal, which is suitable for receiving the molten steel introduced into the vacuum-cast enclosure and for redistributing the molten metal in the mold cavity, is arranged at the upper portion of the mold cavity; and
- the molten metal is introduced into the enclosure so as to form a first jet of molten steel under a vacuum, in order to pour the molten metal over the receiving and distributing means and to form at least one second jet of molten steel under a vacuum, which originates with the receiving and distributing means and terminates in the mold cavity so as to fill the mold cavity with molten metal.

The method according to the invention may comprise one or more of the following features:

- the means for receiving and distributing molten metal is a distributor in the form of a basin including at least one discharge channel, emerging in the mold cavity. The discharge channel can assume different shapes (tube, bend, etc.) and different positions (horizontal, inclined, etc.).
- the means for receiving and distributing molten metal is a cone made from a refractory material whereof the tip is adapted to receive the first jet of molten steel;
- the means for receiving and distributing molten metal bears on the upper end of the core; the core is made up of a generally cylindrical body made from a refractory material comprising a metal axial framework;
- the framework of the core is a metal tube, for example made from steel, the wall of which comprises a plurality of holes;
- the mold is generally of revolution;
- the molten metal is molten steel;
- the pressure in the vacuum enclosure is below 0.2 Torr.

The present invention also provides a steel ingot comprising a longitudinal bore obtained by vacuum casting. The ingot can for example have a shape that is generally of revolution.

The ingot can have a hydrogen content below 1.2 ppm, preferably less than or equal to 1 ppm and more particularly preferably, less than or equal to 0.8 ppm.

The present invention also provides a device for vacuum casting a metal ingot comprising a longitudinal bore, comprising a mold cavity delimited by an ingot mold, a core made from a reinforced refractory material arranged vertically in the ingot mold, a bottom and a means for receiving and distributing molten metal arranged bearing on the upper end of the core.

According to other preferred embodiments, the present invention may comprise one or more of the following features:

- the means for receiving and distributing molten metal is a distributor in the form of a basin comprising at least one discharge channel terminating in the mold cavity;
- the means for receiving and distributing molten metal is a cone made from a refractory material whereof the tip is adapted to receive the first jet of molten steel.

BRIEF DESCRIPTION OF THE FIGURES

The invention will now be described more precisely, in a non-limiting manner, in light of the appended figures, in which.

DETAILED DESCRIPTION

Figure 1:
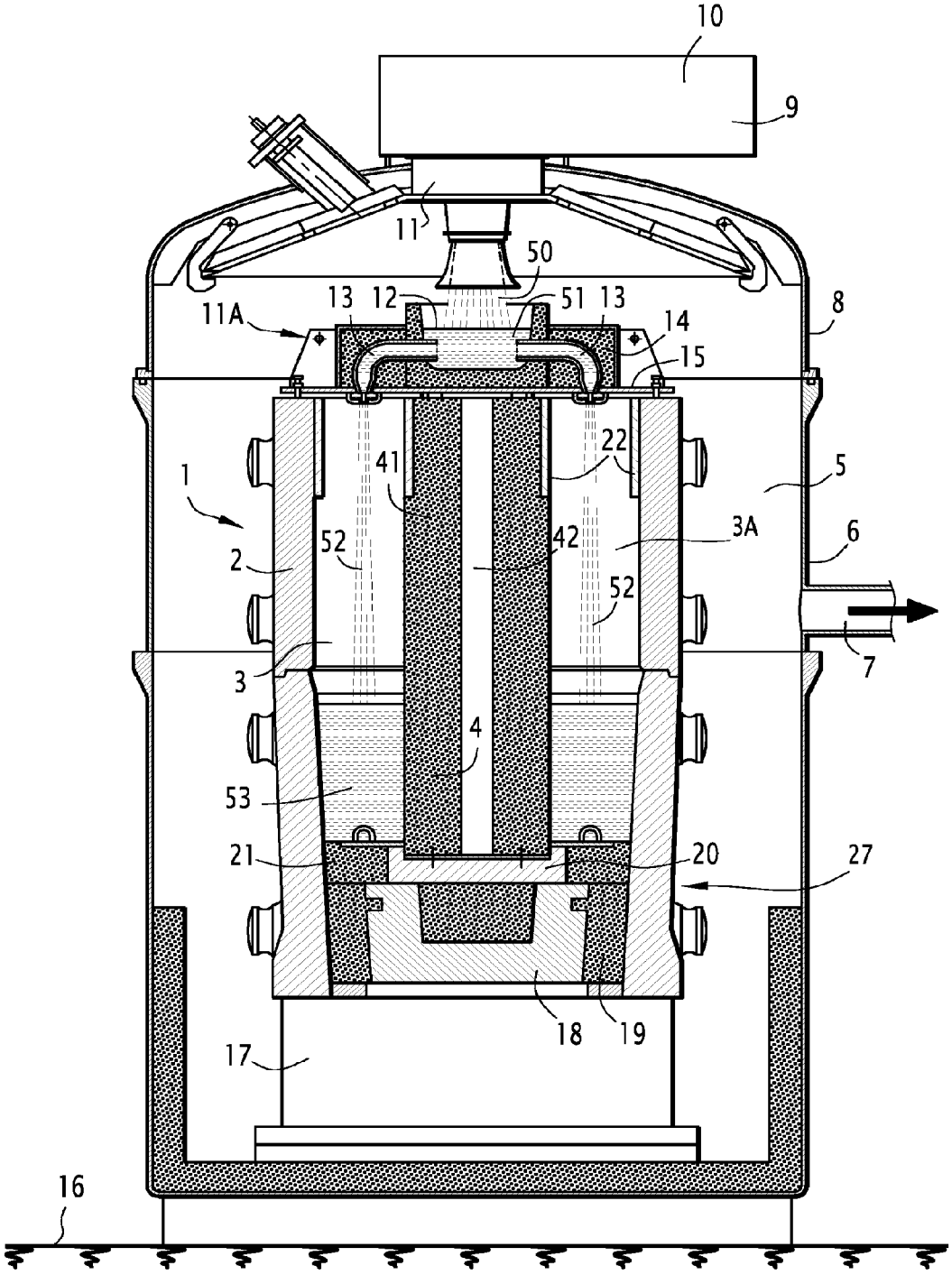
FIG. 1 shows a cross-sectional view of a vacuum cast facility for a metal ingot comprising a longitudinal bore.

FIG. 1 shows a facility making it possible to vacuum cast a metal ingot, and in particular a steel ingot, with a shape generally of revolution and comprising a longitudinal central bore.

This facility comprises a mold 1 intended to mold the metal ingot, made up of a cast iron ingot mold 2 known in itself that delimits a cavity 3 inside which a vertical core 4 is arranged. The unit is arranged in a vacuum cast enclosure 5 made up of a vat 6 closed by a lid 8 comprising a pumping channel 7 connected to a pumping facility. The lid 8 comprises a means 9 for introducing molten metal inside the vacuum enclosure that is made up of an intermediate ladle 10 closed by a sliding gate 11 arranged at the junction between the intermediate ladle 10 and the vacuum enclosure 5.

Such a vacuum cast facility is known in itself and makes it possible to cast molten metal and in particular steel that is first poured into the intermediate ladle 10, which can then be made to penetrate the vacuum enclosure 5 by opening the sliding gate 11 without breaking the vacuum.

The mold 1 rests on a wedge 17 whereof the height is adapted so that the ingot mold is completely arranged in the vacuum cast enclosure 5, said vacuum cast enclosure 5 resting under the ground 16.

In the lower portion of the mold 1, the latter part comprises a bottom generally referenced 27 comprising a wedge means 18, for example, a wedge, and a cast iron backplate 20. The bottom is adapted to obtain the desired ingot height. The wedge means is for example made from cast iron. The space between the wedge means and the side wall of the ingot mold is filled with dry sand 19.

The cast iron backplate 20 intended to receive the lower portion of the vertical core 4 is surrounded by chromite joints 21.

Thus, the ingot mold 2, the core 4, and the bottom 27 delimit a mold cavity, with a generally annular shape, intended to receive the molten metal.

The vertical core 4, with a generally cylindrical shape, is made up, in the outer portion 41 thereof, of chromite surrounding a metal framework made up of a steel tube 42 extending over the entire height and the wall of which may potentially have holes. This metal framework is intended on the one hand to ensure the rigidity and solidity of the vertical core 4 and, on the other hand, to make up a chimney through which the gases resulting from the degassing of the chromite core can escape. The chromite core can advantageously be coated with a refractory coating with a base of zirconium silicate or any equivalent product.

At the upper portion of the mold cavity 3A, plates for risering 22 are positioned on the inner wall of the ingot mold and on the outer wall of the core. Such plates for risering are known in themselves, even by those skilled in the art.

Arranged at the upper portion of the mold is a means 11A for receiving and distributing molten steel that is introduced into the vacuum enclosure. This means 11A for receiving and distributing liquids is made up of a distributor 12 in the form of a basin and formed by tabular alumina, which comprises channels 13 at the periphery thereof that emerge vertically above the mold cavity 3A. The channels 13 are intended to lead the molten steel contained inside the distributor 12 into the mold cavity 3A. These channels 13 are made from a refractory material and are contained in boxes 14 filled with sand. They rest on a support plate 15, which bears on the upper portion of the vertical core 4 and on the upper face of the ingot mold 2.

Figure 2:
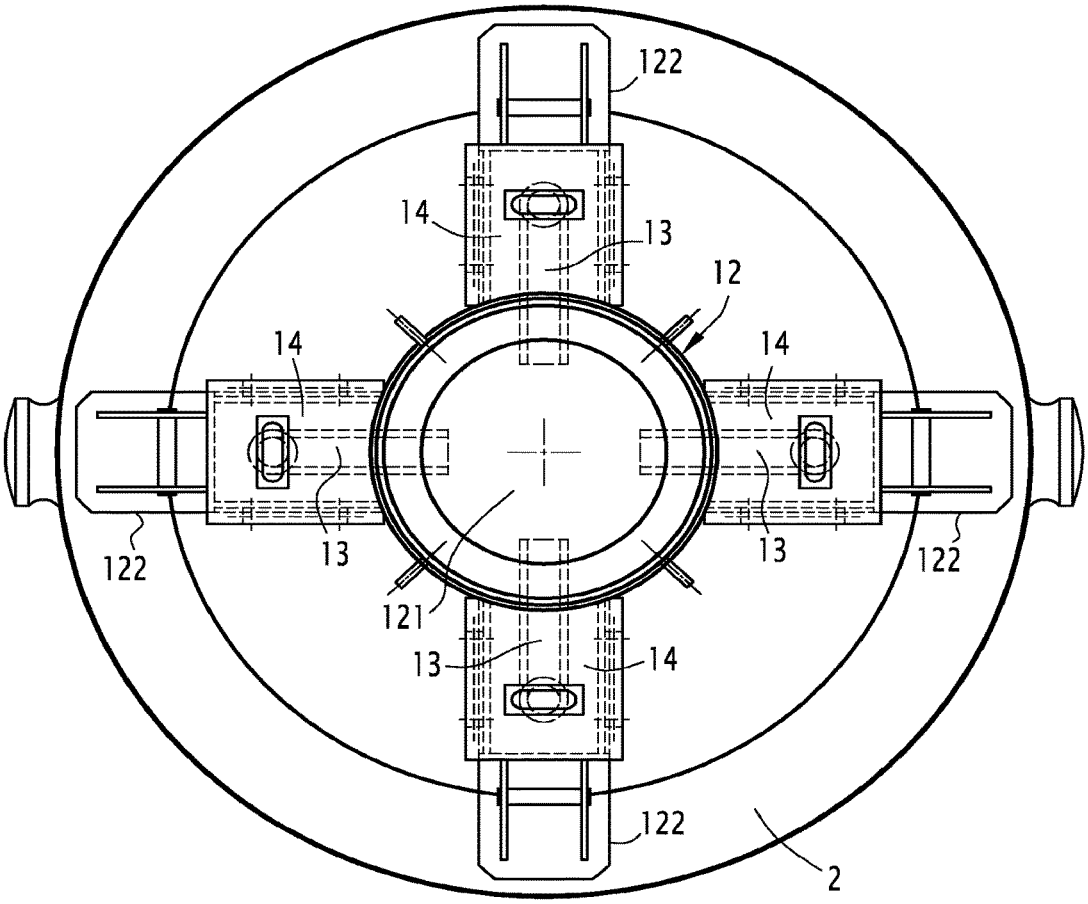
FIG. 2 is a top view of an ingot mold for casting an ingot comprising a longitudinal bore provided with a means for receiving and distributing molten metal.

As shown in FIG. 2, which is a top view, the distributor 12 comprises an inner basin 121 from which four channels 13 originate that are contained in four maintenance boxes containing sand 14 and that are supported by the arms 122 of the support plate 15. These arms 122, which are arranged in a cross, bear on the top of the ingot mold 2.

Lastly, at the upper portion of the mold cavity 3A and near the opening of the channels 13 that make it possible to pour the molten steel into the mold cavity 3A, the mold 1 comprises plates for risering 22 that surround the vertical core 4 on the one hand and the ingot mold 2 on the other. Such plates for risering are known in themselves by those skilled in the art.

A method for casting a metal ingot, and in particular a steel ingot with a shape generally of revolution comprising a central bore also of revolution, will now be described.

After having closed the vat 6 using the lid 8, a vacuum is created in the vacuum cast enclosure 5 by pumping through the channel 7 using a vacuum pumping facility known in itself by those skilled in the art. Thus, the atmospheric pressure inside the vacuum enclosure 5 is decreased to a value that can drop below 0.5 Torr, and more preferably below 0.2 Torr, and still more preferably below 0.1 Torr. Once the vacuum is created in the enclosure, a steel ladle is arranged above the intermediate ladle 10, the molten steel is poured into the intermediate ladle 10. When the intermediate ladle 10 is filled with enough steel, the sliding gate 11 is opened, which makes it possible to introduce the molten steel inside the vacuum enclosure 5. This molten steel forms a first jet 50 that forms a reserve 51 of molten steel in the basin 121 of the distributor 12.

The reserve 51 of molten steel then flows through the channels 13 to form secondary jets 52 that introduce molten steel inside the mold cavity 3A and gradually fill that mold cavity 3 by forming a volume of molten steel 53 inside the mold cavity 3A.

Due to the formation of a plurality of jets 50, 52 of molten steel in a vacuum enclosure 5, which are on the one hand the jet 50 situated between the sliding gate and the distributor 12, and on the other hand the jets 52 for filling the mold cavity 3A, the degassing of the steel is particularly effective. In fact, both the first jet 50 and the other jets 52 are exploded and the explosion of those jets 50, 52 in the vacuum favors the discharge of the hydrogen.

Thus, by using a liquid steel that has first been statically degassed in a static degassing ladle or during a secondary metallurgy operation, so as to have a hydrogen content level preferably comprised between 1.2 and 1.5 ppm, it is possible to obtain an ingot having a longitudinal bore that, when it is still in the molten state inside the ingot mold, can have a hydrogen content level substantially below 0.8 ppm.

In one alternative embodiment, it is, however, possible to start from a molten steel having a hydrogen content level above 1.5 ppm, while still obtaining an ingot whereof the hydrogen content level will be substantially below 0.8 ppm.

Once the mold cavity 3A is filled with molten steel, one proceeds in a known manner by allowing the ingot to solidify within the vacuum cast enclosure 5.

It is then possible to open the vacuum cast enclosure 5 by removing the lid 8, then removing the receiving and distributing means 11A, then stripping the ingot in a manner known in itself by those skilled in the art.

A metal ingot is thus obtained, in particular a steel ingot, and in particular a slightly alloyed steel, having high metallic properties, which can be used to manufacture forged pieces for heavy equipment, such as nuclear power plant vessels or petrochemical equipment. The ingot has a very low hydrogen content level, which can be guaranteed to be lower than 1.2 ppm and even lower than 1 ppm, and better still, possibly lower than 0.8 ppm.

Such an ingot has the advantage of later allowing very simplified forging operations to obtain very high-quality parts. In the embodiment shown here, the means 11A for receiving and distributing molten metal is made up of a distributor 12 comprising a basin and that bears on the central core 4. Other embodiments are possible, the main point being at least to form two successive jets of molten metal, in a vacuum, that can explode so as to perform two successive degassing operations.

Figure 3:
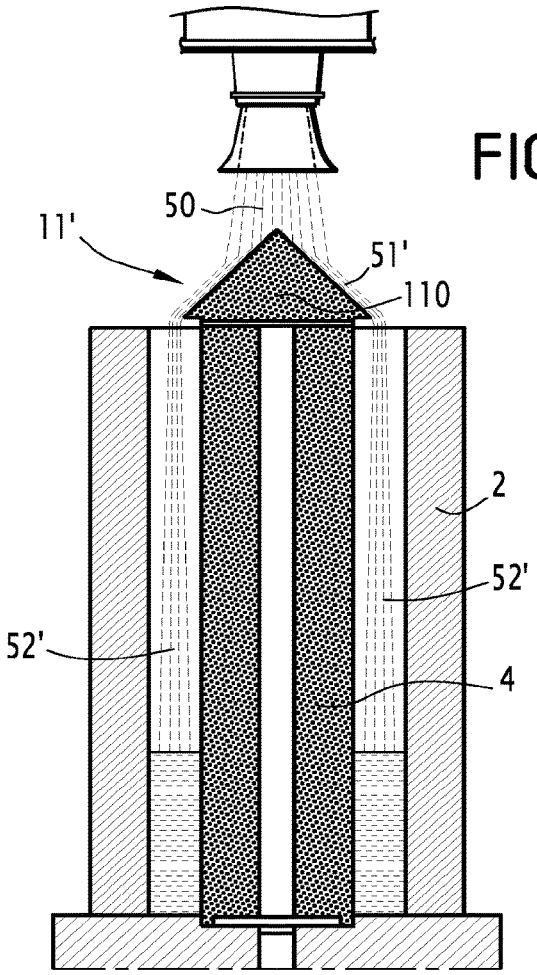
FIG. 3 is a diagrammatic cross-sectional illustration of a second embodiment of the device for distributing molten metal at the apex of the ingot mold for casting an ingot comprising a longitudinal bore.

FIG. 3 shows another possible embodiment in which the ingot mold 2 is topped by a means 11' for receiving and distributing the jet 50 of molten metal that is introduced into the vacuum cast enclosure. This means 11' is made up of a cone 110 bearing on the central core 4. The molten metal that comes from the jet 50 flows over a zone 51' that is on the outer perimeter of the cone 110, then emerges in the mold cavity 3A while forming jets 52' that are exploded and that can ensure very good degassing.

Figure 4:
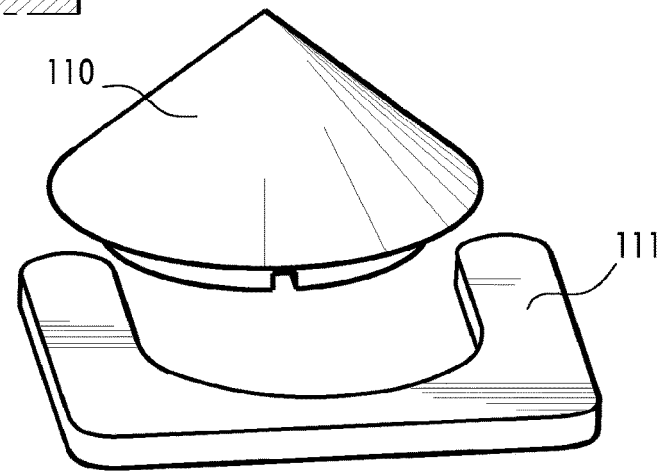
FIG. 4 is an enlarged exploded view of the device for receiving and distributing molten metal shown in FIG. 3.

FIG. 4 shows the cone 110 of the means for receiving and distributing molten steel that is completed by a U-shaped staple 111 intended to maintain the cone 110.

In the preceding description, we have described the manufacture of an ingot generally of revolution comprising an axial bore that is also of revolution. However, one skilled in the art will understand that the ingot and the bore may not be of revolution and that the bore may not be axial. In any case, the mold cavity is said to be generally annular.

Likewise, we have described a core and an ingot mold that are generally cylindrical, but one skilled in the art will understand that the core and/or the ingot mold can also be slightly conical. In general, one skilled in the art will understand that the mold cavity can have reliefs intended to facilitate stripping.

Lastly, in a known manner, the ingot mold can be made up of several assembled segments.

What is claimed is:

1. A molding device for vacuum casting a metal ingot including a longitudinal bore, the device comprising:
- a mold comprising a mold cavity delimited by:
  - an ingot mold;
  - a core extending between a lower end and an upper end comprising:
    - a metal framework; and
    - an outer portion including a reinforced refractory material surrounding the metal framework,
    - the core arranged vertically in the ingot mold; and
  - a bottom for receiving the lower end of the core; and
- a distribution device for receiving and distributing molten metal, said distribution device being arranged bearing on the upper end of the core.

2. The molding device according to claim 1, wherein the distribution device is a distributor in the form of a basin comprising at least one discharge channel terminating in the mold cavity.

3. The molding device according to claim 1, further comprising a first jet providing molten metal to the distribution device.

4. The molding device according to claim 3, wherein the distribution device is a cone made from a refractory material, a tip of the cone receiving molten metal from the first jet.

5. The mold device according to claim 3, wherein the distribution device includes a basin connected to at least one further jet for distributing molten metal into the mold cavity.

6. The molding device according to claim 1, further comprising a source of molten metal.

7. The molding device according to claim 6 wherein the source includes a ladle and sliding gate.

8. The molding device according to claim 1, wherein the reinforced refractory material includes chromite.

9. The molding device according to claim 1, wherein the metal framework is a steel tube.

10. The molding device according to claim 1, wherein the metal framework extends between the lower end and upper end of the core.

11. The molding device according to claim 10, wherein the metal framework extends along an entire length of the core.

12. The molding device according to claim 1, wherein the metal framework includes holes that allow gases to escape.

13. The molding device according to claim 1, wherein the metal framework includes a hollow core.

14. The molding device according to claim 1, wherein the core includes a refractory coating on the outer portion.

15. The molding device according to claim 14, wherein the refractory coating includes zirconium silicate.

16. A device for vacuum casting a metal ingot including a longitudinal bore, the device comprising:
- a mold comprising a mold cavity delimited by:
  - an ingot mold;
  - a core extending between a lower end and an upper end comprising:
    - a metal framework; and
    - an outer portion including a reinforced refractory material surrounding the metal framework,
    - the core arranged vertically in the ingot mold; and
  - a bottom for receiving the lower end of the core; and a means for receiving and distributing molten metal, said means for receiving and distributing molten metal being arranged bearing on the upper end of the core.

* * * * *